US008012662B2

(12) United States Patent
Suganuma

(10) Patent No.: US 8,012,662 B2
(45) Date of Patent: Sep. 6, 2011

(54) METHOD OF MANUFACTURING TONER

(75) Inventor: Tohru Suganuma, Numazu (JP)

(73) Assignee: Ricoh Company Limited, Tokyo (JP)

( * ) Notice: Subject to any disclaimer, the term of this patent is extended or adjusted under 35 U.S.C. 154(b) by 770 days.

(21) Appl. No.: 12/047,460

(22) Filed: Mar. 13, 2008

(65) Prior Publication Data

US 2008/0227021 A1 Sep. 18, 2008

(30) Foreign Application Priority Data

Mar. 15, 2007 (JP) ..... 2007-066482

(51) Int. Cl.
*G03G 5/00* (2006.01)

(52) U.S. Cl. ..... 430/137.18; 430/111.1

(58) Field of Classification Search ..... 430/437.18, 430/111.14, 111.1; 241/5
See application file for complete search history.

(56) References Cited

U.S. PATENT DOCUMENTS

| | | | | |
|---|---|---|---|---|
| 5,934,575 | A * | 8/1999 | Ohnishi et al. | 241/5 |
| 2002/0086231 | A1* | 7/2002 | Naka et al. | 430/137.18 |
| 2005/0130052 | A1* | 6/2005 | Tsunemi | 430/108.4 |
| 2005/0227160 | A1 | 10/2005 | Shirai et al. | |
| 2005/0266333 | A1 | 12/2005 | Yoshimoto | |
| 2006/0032952 | A1 | 2/2006 | Kawamoto et al. | |

FOREIGN PATENT DOCUMENTS

| | | | |
|---|---|---|---|
| EP | 1 091 257 | A1 | 4/2001 |
| EP | 1 249 735 | A2 | 10/2002 |
| JP | 03-209266 | | 9/1991 |
| JP | 06-273978 | | 9/1994 |
| JP | 2002-40705 | | 2/2002 |
| JP | 2002-296831 | | 10/2002 |
| JP | 2003-088770 | | 3/2003 |
| JP | 2006-113473 | | 4/2006 |

OTHER PUBLICATIONS

Office Action issued Jan. 17, 2011 in Japan Application No. 2007-066482.

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A method of manufacturing toner including; melting and kneading a mixture including a binder resin and a coloring agent; cooling down the melted and kneaded mixture to provide a cooled mixture; coarsely pulverizing the cooled mixture to provide a coarsely pulverized mixture; finely pulverizing the coarsely pulverized mixture by supplying it via a pulverized material supply to a pulverizer that includes a rotation axis, a rotor attached to the rotation axis, and stators arranged around the rotor with a gap between the stators and the surface of the rotor and that performs pulverization in a circular space formed by the gap; and classifying the finely pulverized material by a classifier into at least fine powder, a toner product and coarse powder, wherein the coarse powder is returned to the pulverized material supply as part of the coarsely pulverized mixture.

9 Claims, No Drawings

METHOD OF MANUFACTURING TONER

BACKGROUND OF THE INVENTION

1. Field of the Invention

The present invention relates to a method of manufacturing toner.

2. Discussion of the Background

As toner for electrostatic charge image development for use in the image formation process by electrophotography, powder which is formed of toner particles containing a binder resin and coloring agent therein is typically used.

Depending on the function required, a charge control agent for imparting charges to particles, a magnetic material for imparting transport property to toner, and a release agent are admixed to a binder resin and a coloring agent followed by melting and kneading. Subsequent to cooling down and fixation, the kneaded mixture is finely pulverized by a pulverizer and then the resultant is classified according to a desired particle size. Also, a fluidizer, etc. can be added. In the case of a toner for use in a two-component development method, the toner obtained as described above is mixed with a magnetic carrier.

As the typical pulverizer, there are two types of pulverizers, which are: a jet air pulverizer (especially, a collision type air pulverizer) using a jet stream; and a mechanical pulverizer in which powder material is introduced for pulverization into a circular space formed by the gap between a rotor rotating at a high speed and stators arranged around the rotor. The mechanical pulverizer has drawn attention in terms of the environmental issue of recent years because the mechanical pulverizer can pulverize material with less energy than the jet air pulverizer and reduce production of excessively pulverized fine toner, which leads to improvement on yield constant.

To obtain a stably functioning toner, it is inevitable to stabilize the particle size distribution of a toner. Furthermore, a high productivity and a high yield constant are demanded.

In a typical and simple system using such a mechanical pulverizer, coarse powder classified by a coarse powder classifier is directly returned to the mechanical pulverizer. In this system, coarse material is supplied for pulverization from a pulverized material supply to a fine pulverizer. The pulverized material is sent to the coarse powder classifier and coarse powder is separated by classification. The rest is collected by a cyclone to obtain a pulverized product. The emission from the cyclone is discharged by a blower after fine powder is separated by a bug filter. The coarse powder classified by the coarse powder classifier is returned to the pulverizer for circulation. However, when the amount of supply of the coarse powder varies, the load on the pulverizer also fluctuates. The particle size distribution of the toner obtained in such a situation varies and is not stable. In addition, due to the fact that the density of dust in the pulverizer is not uniform but locally high, a problem arises such that toner melts and fixates between a rotor and stators, which prevents stable performance of the pulverizer. Furthermore, due to the load on the pulverizer, heat is generated therein, which leads to deterioration of material, especially deterioration of preservability thereof.

To solve the problems mentioned above, Japanese patent No. (hereinafter referred to as JP) 2833089 describes a technology The technology is that, in a closed loop treatment in which pulverized material is finely pulverized by a pulverizer; coarse powder having a particle diameter greater than a specified value is separated from the resultant by a rotation type air classifier; the coarse powder is supplied to the pulverizer again for fine pulverization treatment, the coarse powder is constantly supplied to the pulverizer in an amount ratio of not greater than 5 times as much as the amount of toner material supplied thereto. However, in this technology, a weight detection device is provided to a device which collects separated coarse powder and returns the coarse powder to the pulverizer again so that complicate control and operation of the closed loop system is inevitable. That is, this technology has a drawback that the facility and operation cost for conducting this method increases, which boosts the manufacturing cost of toner.

In addition, JP 3773063 describes a method of manufacturing toner. In the method, such a device is not controlled by the weight, and the load applied during pulverization is fed back to the amount of feed so that pulverization can be performed under a constant load. In this method, the obtained toner has a stable particle size distribution but an operation of reducing the amount of feed is conducted, which is not preferred in light of productivity.

SUMMARY OF THE INVENTION

Because of these reasons, the present inventor recognizes that a need exists for a method of manufacturing toner by which toner having a specified particle size distribution can be manufactured with a high productivity, a high yield constant, and an excellent preservability by decreasing the amount of heat generated in a pulverizer and deterioration of material.

Accordingly, an object of the present invention is to provide a method of manufacturing toner by which toner having a specified particle size distribution can be manufactured with a high productivity, a high yield constant, and an excellent preservability by decreasing the amount of heat generated in a pulverizer and deterioration of material. Briefly this object and other objects of the present invention as hereinafter described will become more readily apparent and can be attained, either individually or in combination thereof, by a method of manufacturing toner including: melting and kneading a mixture containing a binder resin and a coloring agent; cooling down the melted and kneaded mixture to provide a cooled mixture; coarsely pulverizing the cooled mixture to provide a coarsely pulverized mixture; finely pulverizing the coarsely pulverized mixture by supplying the coarsely pulverized mixture via a pulverized material supply to a pulverizer that includes a rotation axis, a rotor attached to the rotation axis, and stators arranged around the rotor with a gap between the stators and the surface of the rotor and performs pulverization in a circular space formed by the gap; and classifying the finely pulverized material by a classifier into at least fine powder, a toner product and coarse powder, wherein the coarse powder is returned to the pulverized material supply as part of the coarsely pulverized mixture.

It is preferred that, in the method of manufacturing toner mentioned above, the amount of the coarse powder returned to the pulverized material supply is not greater than 3 times as much as an amount of the coarsely pulverized mixture.

It is still further preferred that, in the method of manufacturing toner mentioned above, the coarsely pulverized mixture is set in the mechanical pulverizer together with air having a temperature not higher than 0° C.

It is still further preferred that, in the method of manufacturing toner mentioned above, the following relationship is satisfied: $T \times M/F \leqq 23.0$, wherein T represents the difference between the temperature of the air supplied with the coarsely pulverized mixture to the mechanical pulverizer and the temperature of air discharged therefrom, M (μm) represents a weight average particle diameter of the toner product classified by the classifier, and F (kg/h) represents a supply amount of the coarsely pulverized mixture.

It is still further preferred that, in the method of manufacturing toner mentioned above, the classifier is a multiple separation system classifier that air-classifies powder.

It is still further preferred that, in the method of manufacturing toner mentioned above, the binder resin has a glass transition temperature Tg of from 50 to 75° C. and the temperature of air discharged from the mechanical pulverizer is 10 to 30° C. lower than the glass transition temperature Tg.

These and other objects, features and advantages of the present invention will become apparent upon consideration of the following description of the preferred embodiments of the present invention.

DETAILED DESCRIPTION OF THE INVENTION

The present invention will be described below in detail with reference to several embodiments.

First, the structure of devices for conducting the method of manufacturing toner of the present invention is described.

The devices for use in the method of manufacturing toner of the present invention include a mechanical pulverizer which finely pulverizes coarsely pulverized mixture of toner to a specified pulverization degree and a classifier which classifies and discharges at least part of finely pulverized powder having a particle diameter smaller than a predetermined particle and returns the rest (mainly coarse particles) of the finely pulverized material.

The coarsely pulverized mixture is introduced into the mechanical pulverizer by a material feeder together with a cold air generated by a cool wind generator followed by fine pulverization. The finely pulverized material is sent in an air stream by suction of a blower. Then, the finely pulverized material is separated from the air and collected by a cyclone, and supplied to an air classifier. The air separated by the cyclone is suctioned by a blower via a bug filter.

Next, the finely pulverized material supplied to the air classifier is classified to at least fine powder part of which is used as a toner product and pulverized mixture mainly containing a coarse powder which is returned to the pulverizer. Thereafter, the part of fine powder classified is sent in an air stream by suction of a blower. The fine powder sent in an air stream is separated from the air and collected by the cyclone and discharged as a fine powder product via a double dumper. The air separated at the cyclone is discharged by the blower through the bug filter. The coarse powder, which is not discharged, is returned to the pulverized material supply and then sent again to the mechanical pulverizer together with the pulverized material.

In this system, the coarse powder is not directly returned to a pulverizer. Therefore, the load fluctuation on the pulverizer decreases and thus a toner having a stable particle size distribution can be obtained. Furthermore, since the load fluctuation is small, the heat generation during pulverization can be restrained and thus, deterioration of material is limited. Also, there is no need to provide a constant supply device for coarse powder, which leads to reduction in cost for facilities.

Furthermore, it is preferred that the amount of the coarse powder returned to a pulverized material supply is not greater than three times as much as the supply amount of pulverized material. To obtain a toner having a high yield constant, the coarse powder is pulverized while returned to the mechanical pulverizer. Therefore, it is preferred to improve the pulverization capability, that is, the rotor is rotated at a high speed. This easily leads to excessive pulverization, resulting in the reduction in the yield constant. Consequently, in a typical system in which coarse powder is directly returned to a pulverized material supply, it is preferred that the amount returned to the pulverized material supply is not greater than twice as much as the supply amount of pulverized material. To the contrary, in the present invention, since coarse powder is returned to a pulverized material supply, the load on the mechanical pulverizer is small. Therefore, excessive pulverization does not occur even when the device is operated under the condition of not greater than three times so that toner can be produced with a high constant yield.

As the mechanical pulverizer, it is possible to use a system in which eddy and collision are formed by externally driven rotors, blades, pins, etc. Specific examples thereof include, but are not limited to, a turbo mill and a Kriptron.

In addition, as a classifier by which fine powder having a predetermined particle size can be obtained from finely pulverized pulverization material, an air classifier is preferred. Furthermore, a multi-separation system classifier that classifies powder in air stream using the Coanda effect is more preferred. An example thereof is an Elbow jet. In the multi-separation system air classifier, a material supply nozzle, a material powder introduction nozzle and a high pressure supply nozzle are provided on the top surface thereof and a classification edge block having a classification edge is provided in such a manner that the position thereof can be moved so that the classification range can be changed. Consequently, the classification precision is significantly improved in comparison with a typical air classifier.

During pulverization of toner, it is preferred that air having a temperature not higher than 0° C. is sent in a mechanical pulverizer. As the air is cold (not high than 0° C.), the heat generation during pulverization is limited so that toner can be prevented from melting and fixating between a rotor and stators in the pulverizer. Also, it is preferred that the following relationship is satisfied: $T \times M/F \leqq 23.0$, wherein T represents the difference between the temperature of air supplied with coarsely pulverized mixture to a mechanical pulverizer and the temperature of air discharged therefrom, M (μm) represents the weight average particle diameter of toner product (middle-sized powder) classified by a classifier, and F (kg/h) represents the supply amount of the coarsely pulverized mixture. When the value of $T \times M/F$ is too large, the weight average particle diameter of a toner product (middle sized powder) tends to be large and the supply amount of pulverization material (mixture) is small so that the heat generation during pulverization increases, which is not preferred in terms of productivity and yield constant.

Preferably, the pulverization mixture pulverized by the mechanical pulverizer mentioned above contains a binder resin having a glass transition temperature Tg of from 50 to 75° C. in terms of pulverization property and preservability of toner and the air temperature discharged from the mechanical pulverizer is 5 to 30° C. lower than the Tg.

The binder resin can be used in combination and it is typical to use at least two kinds of resins having a different molecular weight in light of the fixing property and the anti-offset property. The compatibility between these resins has an impact on the glass transition temperature thereof. When the compatibility is good, the glass transition temperature of the resins as a whole is low due to the plasticizing effect thereof. The glass transition temperature of the entire resins may be lower than respective glass transition temperatures of the individual resins in some cases. This causes deterioration of pulverization property and preservability of toner. The preferred toner mentioned above can restrain alteration of a binder resin which is a significant cause of heat alteration and the pulverization material is efficiently pulverized.

As the kinds of binder resins, any known resins can be suitably used. Specific examples thereof include, but are not limited to, polymers of a vinyl-based monomer or oligomer, polyester, polyurethane, epoxy resins, polyvinyl butyral, rosin, modified rosins, terpene resins, phenol resins, aliphatic or alicyclic hydro carbon resins and aromatic petroleum resins. Especially, toner of polyester resins has good fixing property in a heat roller fixing system and has a preferable anti-offset property. Furthermore, it is effective to use a crystalline polyester to improve the low temperature fixing property. When used in combination with an amorphous polyester resin, a toner having a good combination of anti-offset property and the other properties can be obtained.

Such an amorphous polyester resin preferably has a glass transition temperature of from 50 to 75° C. and more preferably from 55 to 65° C. The number average molecular weight (Mn) thereof is preferably from 1,500 to 50,000 and more preferably from 2,000 to 20,000. The weight average molecular weight (Mw) thereof is preferably from 6,000 to 100,000 and more preferably from 10,000 to 90,000. The softening point of the crystalline polyester resin is preferably from 70 to 130° C. in light of the low temperature fixing property.

The weight ratio of the amorphous polyester resin and the crystalline polyester resins is preferably from 95:5 to 70:30 in consideration of the low temperature fixing property, the pulverization property, and the toner preservability.

In addition, the crystal structure of a crystalline polyester is easily destroyed in a mixing and dispersion process with an amorphous polyester. Consequently, the crystalline property tends to become low, which leads to deterioration of the toner preservability. To prevent this, a crystal core agent can be added. Since a fatty acid amide functioning as a crystal core agent has a structure similar to that of a crystalline polyester, both tend to be melted during melting and kneading so that the fatty acid amide can be finely dispersed in the crystalline polyester. In addition, the melting point of the fatty acid amide is higher than that of the crystalline polyester and thus the crystal core agent is crystallized before crystallization of the crystalline polyester. Meaning, the fatty acid amide easily functions as a crystal core agent.

Furthermore, it is suitable to contain a coloring agent, a releasing agent, a charge control agent, magnetic powder, a fluidizer, a cleaning property improver, etc. in toner material.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples 1 to 6 and Comparative Example 1

Toner product (middle sized powder) is obtained as follows: preliminarily mixing the binder resin shown in Table 1 with 2.5 parts of carnauba wax of a release agent, 10.6 parts of carbon black (Regal 1330R, manufactured by Cabot Japan K.K.), 3.0 parts of charge control agent (BONTRON N04, manufactured by Orient Chemical Industries, Ltd.), and 2.0 parts of crystal core agent ethylene bisstearate amide (Kao WAX EB, manufactured by Kao Corporation) by a HENSCHEL MIXER; melting and kneading the resultant with a one-axis kneading machine; rolling the melted and kneaded resultant by a cooling roll; Coarsely pulverizing the resultant with a hammer mill; Finely pulverizing the coarsely pulverized resultant by a turbo mill T250 (manufactured by Turbo Kogyo Co., Ltd.); and Classifying the finely pulverized material by an Elbow jet (EJ-5 type, manufactured by Nittetsumining Co., Ltd.). In Examples 1 to 6, the coarse powder is returned to a pulverization material supplying device and supplied together with pulverization material in constant quantity. In Comparative Example 1, the coarse powder is directly returned to a mechanical pulverizer for fine pulverization. To 100 parts of the obtained middle-sized powder, 0.5 parts of hydrophobic silica is added and the mixture is mixed by a HENSCHEL MIXER. Thereafter, the agglomeration body is removed by a ultrasonic vibration sieve and a toner is thus obtained.

The particle size distribution of toner can be measured by various kinds of methods. In the present invention, the following measuring device is used. That is, Coulter Counter TA II type or Coulter Multisizer II (both are manufactured by Beckman Coulter Co., Ltd.) is used. Primary sodium chloride is used to prepare about 1% NaCl aqueous solution as an electrolyte solution. Also ITOTONR-II (manufactured by Japan Coulter Scientific Inc.) can be used. The volume distribution and the number distribution are calculated by measuring the volume and the number of toner as follows: Adding a surface active agent as a dispersion agent (preferably 0.1 to 5 ml of a salt of alkylbenzene sulfonic acid) to 100 to 150 ml of the electrolyte solution mentioned above; Adding 2 to 20 mg of a measuring sample thereto; Conducting a dispersion treatment to the electrolyte solution in which the measuring sample is suspended by a supersonic dispersion device for about 1 to about 3 minutes; Using the measuring device mentioned above with an aperture of 100 μm to measure the volume and the number of toner. Thereafter, the target weight average particle diameter based on the weight is obtained by the volume distribution relating to the present invention.

The low temperature fixing property is evaluated by the following method: Forming a solid image with an attached amount of toner of 0.4 mg/cm$^2$; Fixing the obtained non-fixed image under the condition of a surface pressure of 2.0 Kgf/cm$^2$, a nip width of 5.0 mm, and a linear velocity of 200 mm/sec; Abrading the obtained fixed image with a smear cloth five times; and measuring the smear cloth by a reflection densitometer (RD-915, manufactured by Macbeth Co., Ltd.). The temperature of the fixing roll when the image density is not greater than 0.4 is defined to be the lowest temperature for fixing.

Preservability is evaluated by the following method.

After 20 g of the toner is preserved at 50° C. for 24 hours, the state of the toner is observed with naked eyes and evaluated according to the following criteria:

G (Good): No agglomeration observed

F (Fair): Agglomeration observed but no actual problem

B (Bad): Lamp observed

In Example 1, since the coarse powder is returned to the polymerization material supply device, the deviation of the weight average particle diameter of the obtained toner is small and the particle diameter distribution is stable in comparison with Comparative Example 1.

In Example 2, the amount of the coarse powder returned to the pulverized material supply is not greater than three times as much as the supply amount of the pulverization material and thus the obtained toner has a stable particle size distribution.

In Example 3, the air temperature introduced in the pulverizer is 0° C. or below so that the particle size distribution is further stable.

In Example 4, T×M/F is 23.0 or below, the most stable particle size distribution is obtained.

In Example 5, T×M/F is still lower than Example 4, the temperature of the air discharged from the pulverizer is low and thus deterioration of the material is little. Consequently, the preservability is good.

In Example 6, the low temperature fixing is good because a crystalline polyester is used. The particle size distribution is also stable.

TABLE 1

| | Binder resin | | | Pulverization condition | | | | |
|---|---|---|---|---|---|---|---|---|
| | Amorphous polyester | | Crystalline polyester | Method of returning coarse powder | Amount of coarse powder returned/ Supply amount of pulverization material | (A) Temperature (° C.) of air introduced into pulverizer | (B) Temperature (° C.) of air discharged from pulverizer | T × M/F |
| Example 1 | Resin A (45) | Resin B (55) | — | Returned to pulverized material supply | 3.4 | 3 | 72 | 31.6 |
| Example 2 | Resin A (45) | Resin B (55) | — | Returned to pulverized material supply | 2.5 | 3 | 73 | 25.0 |
| Example 3 | Resin A (45) | Resin B (55) | — | Returned to pulverized material supply | 1.7 | −5 | 72 | 24.1 |
| Example 4 | Resin A (45) | Resin B (55) | — | Returned to pulverized material supply | 1.3 | −5 | 73 | 22.4 |
| Example 5 | Resin A (45) | Resin B (55) | — | Returned to pulverized material supply | 1.3 | −5 | 42 | 13.4 |
| Example 6 | Resin C (44) | Resin B (55) | Resin E (7) | Returned to pulverized material supply | 1.3 | −5 | 39 | 12.6 |
| Comparative Example 1 | Resin A (45) | Resin B (55) | — | Directly returned to mechanical pulverizer | 3.4 | 3 | 77 | 3.7 |

| | Pulverization condition | | | | Characteristics | | |
|---|---|---|---|---|---|---|---|
| | (B) − (A) (° C.) | Supply amount (Kg/h) of pulverization material | Weight average particle diameter (μm) of product (middle-sized powder) | Amount (Kg/h) of coarse powder returned | Standard deviation of weight average particle diameter | Low temperature fixability | Preservability |
| Example 1 | 69 | 22 | 10.0 | 17 | 0.114 | 140 | F |
| Example 2 | 70 | 28 | 10.0 | 20 | 0.084 | 140 | F |
| Example 3 | 77 | 32 | 10.0 | 20 | 0.071 | 140 | F |
| Example 4 | 78 | 35 | 10.0 | 20 | 0.055 | 140 | F |
| Example 5 | 47 | 35 | 10.0 | 20 | 0.084 | 140 | G |
| Example 6 | 44 | 35 | 10.0 | 20 | 0.114 | 130 | G |
| Comparative Example 1 | 74 | 22 | 10.0 | 17 | 0.179 | 145 | B |

The glass transition temperature of the amorphous polyesters and the softening point of the crystalline polyester are as follows:

Resin A: 80° C. (Glass transition temperature)
Resin B: 83° C. (Glass transition temperature)
Resin B: 61° C. (Glass transition temperature)
Resin D: 64° C. (Glass transition temperature)
Resin E: 110° C. (Softening point)

Figures in parentheses for respective resins represent parts by weight The melting point of crystal core agent Kao Wax EB is 150° C. The weight average particle diameter of middle-sized powder (product) is the average of 5 measured values measured with a 30 minute interval starting one hour after pulverization and classification operation starts.

This document claims priority and contains subject matter related to Japanese Patent Application No. 2007-066482, filed on Mar. 15, 2007, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed is:

1. A method of manufacturing toner comprising:

melting and kneading a mixture comprising a binder resin and a coloring agent;

cooling down the melted and kneaded mixture to provide a cooled mixture;

coarsely pulverizing the cooled mixture to provide a coarsely pulverized mixture;

finely pulverizing the coarsely pulverized mixture by supplying the coarsely pulverized mixture via a pulverized material supply to a mechanical pulverizer that comprises a rotation axis, a rotor attached to the rotation axis, and stators arranged around the rotor with a gap between the stators and a surface of the rotor and that performs pulverization in a circular space formed by the gap; and classifying the finely pulverized material by a classifier into at least fine powder, a toner product and coarse powder, wherein the coarse powder is returned to the pulverized material supply as part of the coarsely pulverized mixture, wherein the coarsely pulverized mixture is supplied to the mechanical pulverizer together with air, and wherein the following relationship is satisfied: $T \times M/F \leqq 13.4$, wherein T represents a difference between a temperature of the air supplied with the coarsely pulverized mixture to the pulverizer and a temperature of air discharged therefrom, M (μm) represents a weight average particle diameter of the toner product classified by the classifier, and F (kg/h) represents a supply amount of the coarsely pulverized mixture.

2. The method of manufacturing toner according to claim 1, wherein an amount of the coarse powder returned to the pulverized material supply is not greater than 3 times as much as an amount of the coarsely pulverized mixture.

3. The method of manufacturing toner according to claim 1, wherein the air supplied with the coarsely pulverized mixture to the mechanical pulverizer is at a temperature not higher than 0° C.

4. The method of manufacturing toner according to claim 1, wherein the classifier is a multiple separation system classifier that air-classifies powder.

5. The method of manufacturing toner according to claim 1, wherein the binder resin has a glass transition temperature Tg of from 50 to 75° C. and the temperature of air discharged from the pulverizer device is 10 to 30° C. lower than the glass transition temperature Tg.

6. The method of manufacturing toner according to claim 1, wherein the binder resin is polyester, polyurethane, an epoxy resin, polyvinyl butyral, rosin, a modified rosin, a terpene resin, a phenol resin, an aliphatic hydrocarbon resin, an alicyclic hydrocarbon resin, an aromatic petroleum resin, or a combination thereof.

7. The method of manufacturing toner according to claim 1, wherein the binder resin is a crystalline polyester, an amorphous polyester resin, or a combination thereof.

8. The method of manufacturing toner according to claim 7, wherein the binder resin is a combination of crystalline polyester and amorphous polyester resin.

9. The method of manufacturing toner according to claim 8, wherein the combination of crystalline polyester and amorphous polyester resin are in a weight ratio of from 95:5 to 70:30.

* * * * *